US005189432A

United States Patent [19]

Lombardi et al.

[11] Patent Number: 5,189,432

[45] Date of Patent: Feb. 23, 1993

[54] RADIATING ANTENNA CABLE APPARATUS

[75] Inventors: Robert Lombardi, Melbourne; George Rassweiler, Indialantic; Jon M. Stern, Melbourne, all of Fla.

[73] Assignee: Harris Corporation, Melbourne, Fla.

[21] Appl. No.: 745,503

[22] Filed: Aug. 15, 1991

[51] Int. Cl.[5] ..... H01Q 11/02

[52] U.S. Cl. ..... 343/739

[58] Field of Search ..... 343/739, 752, 771, 850

[56] References Cited

U.S. PATENT DOCUMENTS

| | | | |
|---|---|---|---|
| 2,474,794 | 6/1949 | Van Beuren | 343/739 |
| 2,966,679 | 12/1960 | Harris | 343/739 |
| 4,115,780 | 9/1978 | Goodman | 343/739 |
| 4,161,736 | 7/1979 | Goodman | 343/739 |

FOREIGN PATENT DOCUMENTS

| | | | |
|---|---|---|---|
| 500162 | 6/1938 | United Kingdom | 343/739 |
| 563493 | 9/1940 | United Kingdom | 343/739 |

*Primary Examiner*—John D. Lee
*Assistant Examiner*—Robert E. Wise
*Attorney, Agent, or Firm*—Evenson, Wands, Edwards, Lenahan & McKeown

[57] ABSTRACT

A distributed antenna system for wireless communication inside enclosed areas such as buildings, tunnels, etc., includes an antenna cable and a termination circuit which provides a plurality of termination impedances for the cable, varying as a function of time. The termination circuit may include a diode coupled to the cable at a remote end of the cable and a bias voltage generator coupled to a local end of the cable. Changes in bias voltage alternately forward biases and reverse biases the diode, effectively changing the termination impedance of the antenna cable. As the impedance changes, nodes and regions of high multipath distortion move, so the probability is greatly increased that personnel with remote communication equipment will be able to send and receive good quality signals over the antenna cable at any given location.

34 Claims, 1 Drawing Sheet

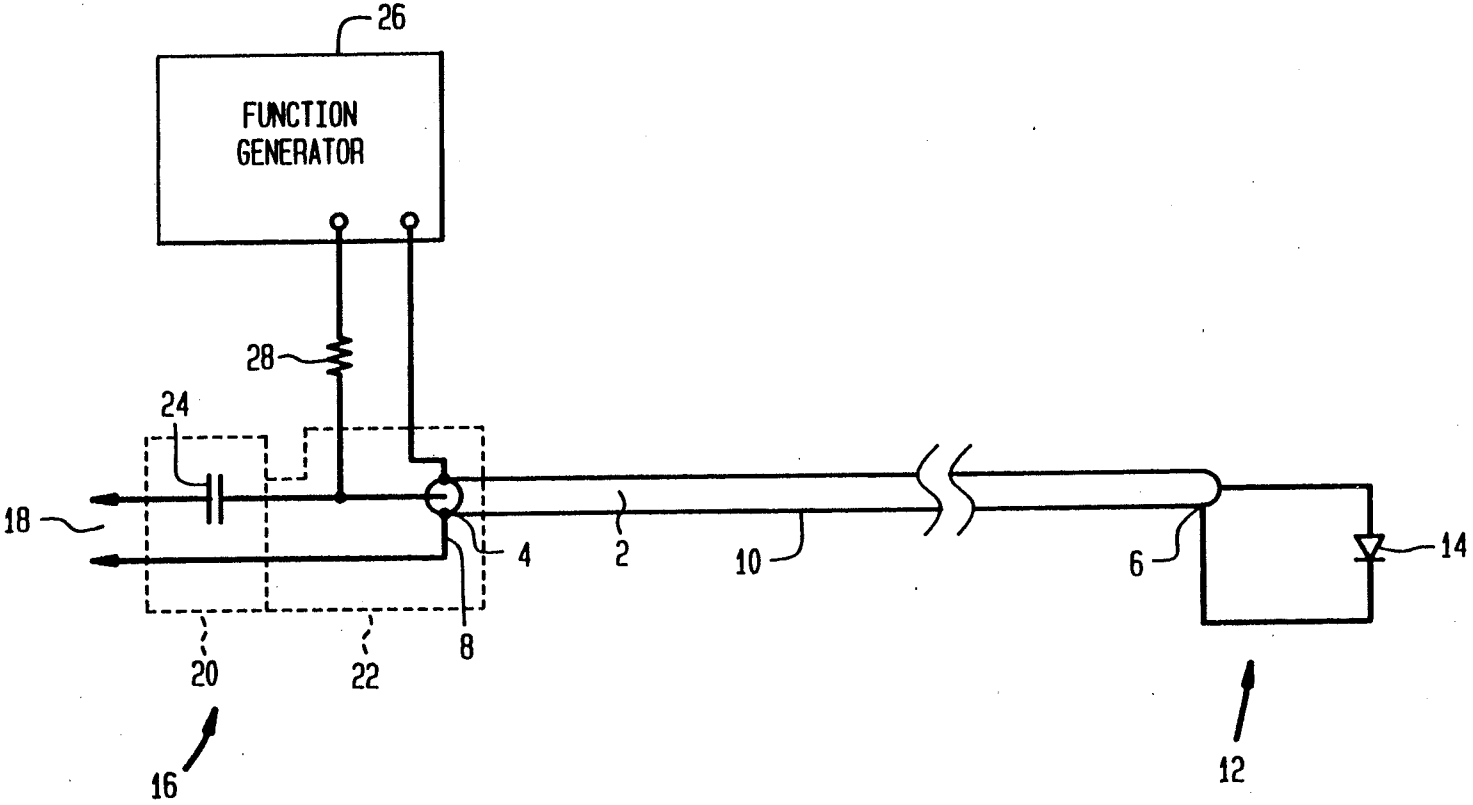
FUNCTION GENERATOR
26
28
24
18
20
22
16
8
4
2
10
6
12
14

RADIATING ANTENNA CABLE APPARATUS

The present invention was conceived and reduced to practice in conjunction with the performance of a U.S. Government Contract, specifically No. NAS 8-50000.

FIELD OF THE INVENTION

The invention generally relates to the field of wireless communication systems. More specifically, the invention relates to distributed antenna systems for use in enclosed areas for communication with personnel inside the areas.

BACKGROUND OF THE INVENTION

In large modern buildings such as office buildings, multiunit residences, etc., there are often large networks of floors, hallways, or tunnels. The hallways or tunnels may run in long, straight paths or may abruptly turn at sharp angles. Buildings are constructed using structural steel supports or metallic wall studs. Also, aircraft and ships often have confined passageways. Such buildings, hallways, or tunnels provide a very challenging environment for wireless communications. Yet, there is a need for practical wireless communication systems which provide two-way communication between a base station, which might be in a particular office cf the building, and portable communication equipment carried by maintenance or security personnel. Preferably, the personnel should be able to use standard portable radio equipment or other standard equipment for wireless electromagnetic (EM) communication.

In order for a wireless communication system to work effectively inside enclosed areas such as hallways or tunnels, two requirements must be met. First, an EM field carrying signals transmitted from the base station to the personnel must have substantially equal field strength for all regions in the areas. Second, the system must be approximately equally sensitive to signals transmitted by the personnel using their portable equipment regardless of the location of the personnel within the enclosed area. These objectives have proven very difficult to realize in practice.

The structural members and other reflective surfaces which were used in construction of the enclosed areas provide a bewildering maze of reflective surfaces for EM radiation. Accordingly, enclosed areas experience multipath distortion, including deep nulls due to factors such as phase cancellation. The distortion and nulls are distributed throughout the enclosed areas. As a practical matter, the complexity of the structure of enclosed areas makes it impossible to predict by analysis where the distortion and nulls will be located. A mere few inches may separate an area of strong, clear reception from a null area in which reception is nearly inaudible. Accordingly, it is impracticable to design a system in which the distortion and nulls may be located in out-of-the-way places.

Conventional communications systems have been used including multiple conventional antennas, multiple feedlines, and power splitters in order to propagate signals around sharp bends or bulkheads and reduce or eliminate nulls. Such systems, however, are disadvantageously complex and expensive, particularly because transmitters and receivers used at the base station and used by the remote personnel must be able to d al with a large standard deviation of signal strength, i.e., from deep nulls up to areas of strong reception.

A simpler and less expensive communication system has been used employing slotted coaxial cable antennas running along hallways or tunnels. A slotted coaxial cable antenna is mechanically simpler and cheaper than other conventional systems, but is still subject to multipath interference effects, including nulls. In order to make the system usable in spite of the distortion and nulls, high power transmitters have been used, so that even nulls are boosted enough that their signals are audible. However, this brings about the additional disadvantage of undesirably high power consumption. The additional power, or "system use factor", may require on the order of 20 dB of additional power for satisfactory signal strength.

A further technique has been used for designing systems for overcoming the problem of distortion and nulls. Two or more distributed antennas having different characteristics are laid throughout the enclosed area. Due to the different characteristics, if a given position in the enclosed area has a null for one antenna, the likelihood is small that another antenna will also have a null there. Communication equipment may be used which alternates on a time division basis between the signals of the antennas, or which has intelligent circuitry for selecting the strongest signal. Thus, the communication problems caused by distortion and nulls are largely eliminated. However, considerable additional cost is still incurred due to the redundant antennas and the more specialized and complex communication equipment.

Therefore, there remains a need for a simple and inexpensive, yet effective, system for wireless communication in enclosed areas.

SUMMARY OF THE INVENTION

It is thus an objective of the invention to provide a communication system for enclosed areas which is simple and inexpensive but which substantially eliminates the need for high power to overcome nulls.

To achieve this and other objectives, there is provided in accordance with the invention a distributed antenna system comprising an antenna cable, a direct current (DC) bias circuit coupled to the antenna cable, the DC bias circuit including circuitry for providing first and second time multiplexed DC bias voltages, and a cable termination circuit coupled to the antenna cable for providing first and second cable termination impedances responsive to the first and second DC vias voltages.

A system according to the invention provides numerous advantages for the user. As the bias voltage changes value due to the time multiplexing, the locations of nodes and areas of high distortion move. In any given location, it is substantially certain that for at least part of the time, the field induced around the antenna will provide an adequately strong signal for that area. At any rate, the probability that any given location will have nulls for both termination impedance values will be substantially closer to zero than is the probability that the given location will have a null for a given single termination impedance. Thus, the advantages of the multiple distributed antenna system are provided without the additional cost due to redundant equipment.

BRIEF DESCRIPTION OF THE DRAWINGS

The invention will be understood by one of ordinary skill in the art from the detailed description which follows, with reference to the drawings, in which:

The single FIG. is a schematic diagram of a distributed antenna system in accordance with the invention.

DETAILED DESCRIPTION OF THE PREFERRED EMBODIMENTS

A preferred embodiment of an antenna system according to the invention includes an antenna cable which is laid inside an enclosed area, so that at any position which maintenance or security personnel are likely to occupy, a portion of the antenna cable will be nearby. For instance, in a building having hallways or corridors, the antenna cable will be laid along the hallways or corridors and will follow any turns the hallways or corridors make. Thus, a maintenance or security person moving through the hallways or corridors will remain alongside the antenna cable and will at all times be within wireless communication range of the cable.

While various types of cables may be used as the antenna cable of the invention, radiating coaxial cables such as spiral wound, slotted, or helical coaxial cables may be used. Slotted coaxial cables are used in a preferred embodiment. Specifically, RXL 4-3 "Radiax" Cable manufactured by Andrew Corp. has been used successfully.

Referring now to the FIG. there is shown a schematic diagram of an antenna system according to the invention. There is shown a length of cable 2 having a local end 4 and a remote end 6. The cable 2 is shown as coaxial cable having a conductive core 8 and a conductive shield 10 disposed around the core 8. An insulating material surrounds the core 8 and insulates it from the shield 10. The cable 2 may be laid along a hallway, corridor, or tunnel along which communication is to be provided. Typically, communication will be betwen a base station, which might be located at an office or other central location within the building, and personnel elsewhere in the hallway, corridor, or tunnel. The local end 4 of the cable 2 is positioned at the base station. The remote end 6 is then positioned at a farthest point along the corridor, hallway, or tunnel.

In accordance with the invention, the antenna system includes means for changing the impedance of the antenna cable as a function of time. It will readily be understood that the characteristics of an electromagnetic field induced around the antenna cable 2 will depend, in part, on the cable impedance. It thus follows that the locations of nulls or areas of high multipath distortion in the field will also depend, in part, on the cable impedance. As the cable impedance change, the positions of the nulls and areas of distortion move. As a consequence, if a given position along the enclosed area which the antenna cable occupies has a null for one cable impedance, the probability is high that, at the other cable impedance, the null will either disappear or move to another location. Thus, even if communication is largely disrupted at the given position by a null for one impedance, communication at that position will probably be much better facilitated at the other cable impedance. As a general rule, nodes change position by a distance related to the magnitude of the change in the cable termination impedance. Within the present specification, the words "large" and "small", or synonyms, are used to refer to cable impedances produced by the means for changing. For instance, in a preferred embodiment described in more detail below, the means for changing include a termination circuit including a diode coupled to the remote end of the antenna cable 2. With regard to this embodiment of the invention, cable termination impedances related to forward bias and reverse bias impedances of the diode shall be referred to as large and small. However, in the broadest sense, large and small impedances, or a large difference between first and second impedances, shall be understood to refer to impedances which bring about changes in positions of nodes such that the changed positions of the nodes shall not overlap. Accordingly, there shall be achieved the advantage that, at any given position within the enclosed area in which the antenna cable is deployed, for at least one cable termination impedance value the signal strength shall not be a node. While, for the preferred embodiment, forward and reverse bias diode impedances have been found to be great enough to cause nodes to move far enough that they do not overlap, depending on the carrier or modulation frequency used, the first and second cable termination impedances need not necessarily be as great or small as the diode impedances to cause adequate movement of the nodes. A person of ordinary skill in the art will be able to determine empirically what impedance values shall be sufficient to move the nodes far enough part, using a test method similar to that described below or a method of the person's own devising, without requiring undue experimentation.

In accordance with the invention, the means for changing cable impedance include two components. First, a cable termination circuit 12 is coupled to the remote end 6 of the antenna cable 2. In a preferred embodiment, the cable termination circuit 12 includes circuitry which has two different impedances responsive to two different direct current (DC) bias voltages over the antenna cable 2. In the embodiment of FIG. 1, the termination circuit 12 includes a diode 14. As shown, the diode 14 has an anode coupled to the core 8 of the cable 2, and a cathode coupled to the shield 10. In a preferred embodiment, a IN4148 diode has been used.

DC bias voltages are applied to the antenna cable 2 in a manner to be described below. The bias voltages should have values which, respectively, forward bias and reverse bias the diode 14. These values will, of course, vary according to the type of diode used. Bias voltage values for various diodes may be derived from experimentation or readily available diode data catalogs. The diode 14 may be forward biased by applying a suitable positive voltage to the cable 2. For instance, a positive voltage may be applied to the core 8 and ground to the shield 10. As a consequence, the diode 14 is rendered conductive and the impedance of the diode 14 is rendered very small. Again, exact forward bias impedance values for various diodes may be derived from experimentation or diode data catalogs. On the other hand, the diode 14 may be reverse biased by applying a different bias voltage. For instance, if the diode 14 has a typical forward bias voltage of about 0.7 volts, the shield 10 may be grounded and the core 8 may be biased to a voltage of only a few tenths of a volt, or near ground. In this case, the diode 14 is rendered non-conductive, and the impedance of the diode 14 is rendered very large.

It has been found that changing the termination impedance of the antenna cable 2 from a very large value to a very small value, such as the large impedance value of a reverse biased diode and the very small impedance of a forward biased diode, tends to cause nodes to shift in position by a distance equal to about ½ of the wavelength of the carrier frequency. In a preferred embodiment, an ultra-high frequency (UHF) carrier of 445 MHz has been used. Accordingly, the change in antenna termination impedance has been shown to cause the nodes to move a distance of about 10 to 13 inches.

The second component of the means for changing cable impedance is a DC bias circuit, shown generally as 16, coupled to the local end 4 of the antenna cable 2. The bias circuit generally includes an interface 18, a DC isolation circuit 20, and a bias voltage generator 22. As shown, the components of the bias circuit 16 are coupled in common to the shield 10 of the antenna cable 2. This is consistent with the convention that the shield of a coaxial cable is usually grounded. However, other suitable common connections may alternatively be used. The interface 18 includes any suitable mechanical or electronic hardware for coupling the antenna system to a communication transceiver at a base station. The interface 18 may include a mechanical connect of for detachably coupling to the transceiver, and may also include an electronic interface circuit as necessary for transmitting a transmit signal from the transceiver at the base station to the remote personnel and for receiving a signal from the remote personnel to the base station.

The DC isolation circuit 20 is coupled between the interface 18 and the antenna cable 2. The DC isolation circuit 20 isolates the DC bias voltage from the transceiver coupled to the interface 18, so that the bias voltage does not interfere with the operation of the transceiver. The DC isolation circuit 20 may preferably include a capacitor 24 coup ed in series between the interface 18 and the cable 2.

The bias voltage generator 22 is coupled between the DC isolation circuit 20 and the antenna cable 2. The bias voltage generator 22 may be coupled in series between the circuit 20 and the cable 2 or otherwise, as appropriate. In the preferred embodiment shown, the generator 22 is coupled between ground and a circuit node at which the core 8 of the cable 2 is coupled to the DC isolation circuit 20. The result is a "T" configuration, which may be provided simply by suitably coupling contacts together, or through the use of a T connector.

The bias voltage generator 22 includes means for producing a voltage which varies between first and second values according to a predetermined duty cycle The means for producing may be any circuit or device which produces a voltage which varies between two or more levels as a function of time. In a preferred embodiment, the means for producing include a function generator 26. Preferably, the generator 26 permits operator control of factors such as voltage values, durations of the values, a frequency at which the generator 26 cycles between the selected voltage values, and a duty cycle with regard to the different voltage values. The function generator 26 may be a commercial stand-alone function generator for generating square waves, sawtooth waves, etc. If such a device is employed, it is preferred that a square wave or rectangular wave mode be selected. Alternatively, the generator 26 may be a suitable circuit such as an a stable multivibrator. In either case, the function generator 26 may preferably have a signal output and a ground or common output. In such a case, the ground output may be coupled to the shield 10 of the cable 2, and the signal output may be coupled through a resistor 28 to the core 8 of the cable 2.

The function generator 26 should preferably produce a bias voltage which changes value according to a predetermined frequency which is greater than the maximum modulation frequency of the information to be transmitted over the antenna to avoid perceptible flutter. For instance, audio communication is based on the human audible spectrum. For high fidelity audio equipment, the greatest limits of the human audible spectrum are generally treated as 20 Hz and 20 kHz. Many ordinary voice communication devices, such as telephones and portable radios, use a considerably lower upper frequency limit. Thus, in a preferred embodiment, a function generator which produces a square wave at 20 to 25 kHz has been found to produce suitable modulation of the antenna termination impedance for transmitting satisfactory quality audio signals.

A communication system employing an antenna system according to the invention has been used successfully. A small ultra-high frequency (UHF) communication device operating on a 445 MHz band was used along with a length of Andrew Corp. RXL 4-3 "RADIAX" cable. A Wavetek function generator having sine, square, and triangle capability was coupled through a 750 ohm resistor to the node between the DC isolation capacitor and the core 8.

In a test arrangement, such a communication system employing a 40 foot length of cable was deployed in a 40'×9'×8' trailer. Signal strength measurements taken at the local end of the cable responsive to transmissions from a 445 MHz transmitter at various positions inside the trailer indicated that nulls in given positions for a first impedance value were reduced in depth by 10 dB or more for a second impedance value, and that an average loss over the entire path and a standard deviation over the path were both substantially reduced. The depth reduction of the nodes indicated a degree or distance which the nodes moved responsive to the change in cable termination impedance.

The invention has been described in terms of preferred embodiments. However, it will be understood that the embodiments described are for illustrative purposes, and are not meant to be limiting or exhaustive of the scope of the invention. Rather, it is intended that any equivalent apparatus or methods which would be obvious to one of ordinary skill in the art shall fall within the spirit and scope of the invention.

What is claimed is:

1. A distributed antenna system comprising:

an antenna cable;

a direct current (DC) bias circuit coupled to the antenna cable, the DC bias circuit including circuitry which provides first and second multiplexed DC bias voltages; and a cable termination circuit coupled to the antenna cable which provides first and second cable termination impedance in response to the first and second time multiplexed DC bias voltages.

2. A distributed antenna system as recited in claim 1 wherein the antenna cable includes a radiating coaxial cable.

3. A distributed antenna system as recited in claim 2 wherein the radiating coaxial cable includes a conductive core and a conductive shield disposed about the core, and the cable termination circuit is coupled between the shield and the core.

4. A distributed antenna system as recited in claim 1 wherein the bias circuit includes an input and a DC block circuit coupled between the input and the antenna cable.

5. A distributed antenna system as recited in claim 4 wherein the DC block circuit includes a capacitor coupled in series between the input and the antenna cable.

6. A distributed antenna system as recited in claim 1 wherein the bias circuit includes a bias voltage generator coupled to the antenna cable.

7. A distributed antenna system as recited in claim 6 wherein the bias voltage generator includes means for producing a voltage which varies between first and second values according to a predetermined duty cycle.

8. A distributed antenna system as recited in claim 7 wherein the means for producing include a function generator.

9. A distributed antenna system as recited in claim 8 wherein the function generator produces a 50% duty cycle voltage.

10. A distributed antenna system as recited in claim 8 wherein the voltage produced by the function generator varies between the first and second values at a predetermined frequency.

11. A distributed antenna system as recited in claim 10 wherein:

the bias circuit includes an interface for coupling with a base transceiver for transmitting and receiving information having a frequency bandwidth including a maximum modulation frequency, and the predetermined frequency is greater than the maximum modulation frequency.

12. A distributed antenna system as recited in claim 1 wherein:

the cable termination circuit includes means for providing first and second cable termination impedances responsive to the first and second time multiplexed DC bias voltages.

13. A distributed antenna system as recited in claim 12 wherein the cable termination circuit includes a diode.

14. A distributed antenna system as recited in claim 13 wherein the diode has an anode coupled to a core of the coaxial cable and a cathode coupled to a shield of the coaxial cable.

15. A distributed antenna system as recited in claim 13 wherein the first bias voltage forward biases the diode, effectively producing a termination impedance substantially equal to a forward bias impedance of the diode, and the second bias voltage reverse biases the diode, effectively producing a termination impedance substantially equal to a reverse bias impedance of the diode.

16. A distributed antenna system comprising:

an antenna cable; and means for providing the cable with first and second time multiplexed cable termination impedance values.

17. A distributed antenna system as recited in claim 16 wherein the means for providing include a termination circuit coupled to the antenna cable.

18. A distributed antenna system as recited in claim 17 wherein the antenna cable has a remote end, and the termination circuit is coupled to the remote end of the antenna cable.

19. A distributed antenna system as recited in claim 17 wherein the termination circuit includes a diode, and the termination circuit has the first termination impedance value when the diode is forward biased and the second value when the diode is reverse biased.

20. A distributed antenna system as recited in claim 19 wherein the antenna cable is a radiating coaxial cable having a conductive core and a conductive shield, and the diode has an anode coupled to the core and a cathode coupled to the shield.

21. A distributed antenna system as recited in claim 16 wherein the means for providing include a direct current (DC) bias circuit.

22. A distributed antenna system as recited in claim 21 wherein the antenna cable has a local end, and the DC bias circuit is coupled to the local end.

23. A distributed antenna system as recited in claim 21 wherein the bias circuit includes an input and means for blocking DC coupled between the input and the antenna cable.

24. A distributed antenna system as recited in claim 23 whereon the means for blocking include a capacitor.

25. A distributed antenna system as recited in claim 21 wherein the bias circuit includes a bias voltage generator coupled to the antenna cable.

26. A distributed antenna system as recited in claim 25 wherein the bias voltage generator includes a function generator which produces a voltage which varies between first and second values according to a predetermined duty cycle.

27. A distributed antenna system as recited in claim 26 wherein the function generator produces a 50% duty cycle voltage.

28. A distributed antenna system as recited in claim 26 wherein the voltage produced by the function generator varies between the first and second values at a predetermined frequency.

29. A distributed antenna system as recited in claim 28 wherein:

the bias circuit includes an interface for coupling with a base transceiver for transmitting and receiving information having a frequency bandwidth including a maximum frequency, and the predetermined frequency is greater than the maximum frequency.

30. A method for wireless communication through a distributed antenna cable in an enclosed area comprising the steps of:

changing a termination impedance of the cable to alternate between first and second impedance values, whereby, for a given carrier frequency, multipath nodes in the enclosed area change positions responsive to the step of changing.

31. A method as recited in claim 30 wherein the step of changing includes providing alternating first and second direct current (DC) bias voltages to the antenna cable as a function of time.

32. A method as recited in claim 30 wherein:

the antenna cable has a remote end;

a termination circuit is coupled to the remote end to provide a termination impedance; and the step of changing includes changing the termination impedance of the termination circuit.

33. A method as recited in claim 32 wherein:

the termination circuit includes a diode; and the step of changing includes providing a direct current (DC) bias voltage to the antenna cable, the DC bias voltage varying in time between first and second values which, respectively forward bias and re bias the diode, thereby causing an impedance of the diode to change between a small forward bias impedance and a large reverse bias impedance.

34. A method as recited in claim 30 wherein:

the distributed antenna cable has an interface for coupling with a base transceiver for transmitting and receiving information having a frequency bandwidth including a maximum frequency, and the step of changing includes changing the termination impedance at a frequency greater than the maximum frequency.

* * * * *